United States Patent [19]

Keller

[11] 4,437,266

[45] Mar. 20, 1984

[54] WEATHERSTRIPPING KIT FOR SLIDING WINDOWS

[76] Inventor: Wilbur L. Keller, 9320 Idyl Pl., Lakeside, Calif. 92040

[21] Appl. No.: 338,859

[22] Filed: Jan. 12, 1982

Related U.S. Application Data

[63] Continuation of Ser. No. 132,694, Mar. 21, 1980, abandoned.

[51] Int. Cl.[3] ..... E06B 7/16

[52] U.S. Cl. ..... 49/493; 49/406; 49/485

[58] Field of Search ..... 49/493, 406, 485, 458, 49/425; 52/207

[56] References Cited

U.S. PATENT DOCUMENTS

| | | | |
|---|---|---|---|
| 1,556,461 | 10/1925 | Thill | 49/485 X |
| 1,877,448 | 9/1932 | Fitzgerald | 49/493 |
| 1,996,635 | 4/1935 | Axe | 49/485 |
| 2,040,133 | 5/1936 | Harnly | 49/493 X |
| 2,841,834 | 7/1958 | Poole, Jr. | 49/489 X |
| 2,970,642 | 2/1961 | Parsons | 49/485 X |
| 3,208,564 | 9/1965 | Sitterly | 49/485 X |
| 3,324,597 | 6/1967 | Rich | 49/406 |
| 3,763,596 | 10/1973 | Anderson | 49/493 X |
| 4,112,623 | 9/1978 | McPherson | 49/406 X |
| 4,193,500 | 3/1980 | Scott | 49/425 X |

*Primary Examiner*—Philip C. Kannan

*Attorney, Agent, or Firm*—Brown & Martin

[57] ABSTRACT

A weatherstripping kit for sliding windows that are installed within opposing window channels defined by side channel walls, for movement parallel to an adjacent stationary panel. The kit includes a pair of first elongated weatherstripping holders for attachment to the side channel walls of opposing channels for holding weatherstripping in contact with the sliding window for providing a seal between the channel walls and the window over the width of the window when the window is closed. The kit also includes a second elongated weatherstripping holder for attachment to the sliding window at the end of the window adjacent the stationary panel for holding weatherstripping in contact with the stationary panel for providing a seal between the sliding window and the stationary panel over the length of the sliding window. The kit additionally includes a third elongated weatherstripping holder for attachment to the end channel wall of the window jamb for holding weatherstripping in contact with the end of the sliding window that is received when the sliding window is closed for providing a seal between the end channel wall and the sliding window over the length of the sliding window when the sliding window is closed. The elongated holders are aluminum extrusions. The kit further includes adhesive strips for effecting attachment of the elongated holders.

14 Claims, 5 Drawing Figures

WEATHERSTRIPPING KIT FOR SLIDING WINDOWS

This is a continuation of application Ser. No. 132,694 filed Mar. 21, 1980 now abandoned.

FIELD OF THE INVENTION

The present invention pertains to an improvement in weatherstripping for sliding windows. As used herein the term "sliding windows" includes both sliding windows located at typical window levels and sliding windows that extend to the floor and also function as sliding doors. The present invention is applicable to windows that slide horizontally and to windows that slide vertically.

Sliding windows are installed in opposing window channels for movement parallel to an adjacent panel. The opposing window channels are defined by side channel walls mounted to the base of a window jamb in a wall on opposite sides of the window. Typically, the adjacent panel also is a window panel. The window pane of a sliding window usually is encased in a frame that slides in the channels. Usually, rollers are attached to the sides of the window frame to facilitate easy movement of the frame in the channels. The opposing portions of the window that slide within the channels are referred to as the sides of the windows; whereas the other two opposing extreme portions are referred to as the ends of the windows.

Quite often sliding windows that are installed in homes and other buildings are not weather tight. As a result, they leak wind and rain, especially during severe storms when there are strong gusting winds. Many sliding windows are originally installed with some weatherstripping being attached to the sliding window frame and/or to channel walls at the sides of the window jam and/or at the end of the window jamb that receives one end of the sliding window when the window is closed. However, such originally installed weatherstripping is not always adequate to keep out wind and rain. When the originally installed weatherstripping is not adequate, it is necessary to use a weatherstripping kit to fortify such sliding windows with adequate weatherstripping.

SUMMARY OF THE INVENTION

The present invention is an improved weatherstripping kit for sliding windows that are installed within opposing window channels defined by side channel walls, for movement parallel to an adjacent stationary panel. The kit includes a first elongated weatherstripping holder for attachment to a side channel wall for holding weatherstripping in contact with the sliding window for providing a seal between the side channel wall and the window over the width of the window when the window is closed; and a second elongated weatherstripping holder for attachment to the sliding window at the end of the window adjacent the stationary panel for holding weatherstripping in contact with the stationary panel for providing a seal between the window and the panel over the length of the window. The width of the window is the distance between its opposing ends; and the length of the window is the distance between its opposing sides. The term "in contact with the sliding window" refers to contact with either the frame or the pane of the window. The term "for attachment to the sliding window" refers to attachment to either the frame or the pane of the window.

Preferably, the improved weatherstripping kit includes two of the first elongated weatherstripping holders for attachment to side channel walls of both of the opposing window channels.

It also is preferable that the improved weatherstripping kit include a third elongated weatherstripping holder for attachment to the end channel wall for holding weatherstripping in contact with the received end of the sliding window for providing a seal between the end channel wall and the window over the length of the window when the window is closed.

The improved kit of the present invention enables adequate weatherstripping to be applied readily to previously installed sliding windows.

The distinguishing features of the present invention are described with reference to the description of the preferred embodiment.

DESCRIPTION OF THE PREFERRED EMBODIMENT

Figure 1:
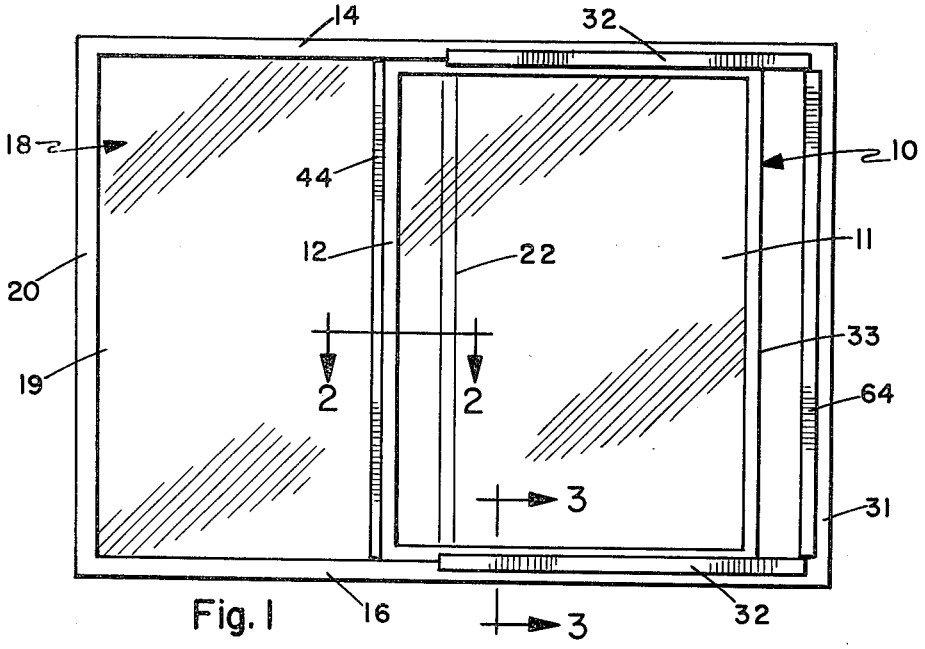
FIG. 1 illustrates a typical sliding window incorporating the improved weatherstripping kit of the present invention.
Figure 2:
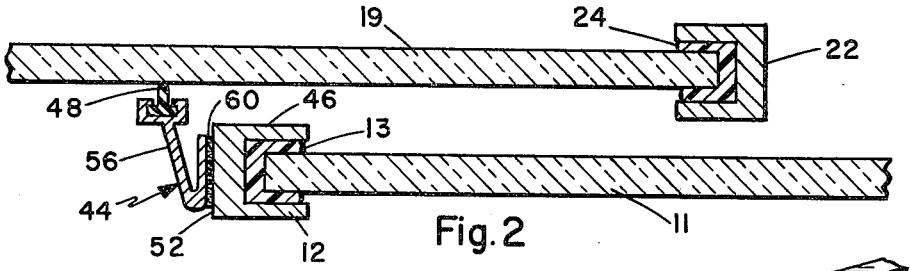
FIG. 2 is an enlarged sectional view taken on line 2—2 of FIG. 1.
Figure 3:
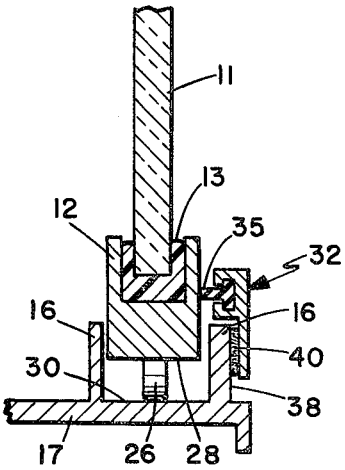
FIG. 3 is an enlarged sectional view taken on line 3—3 of FIG. 1.
Figure 4:
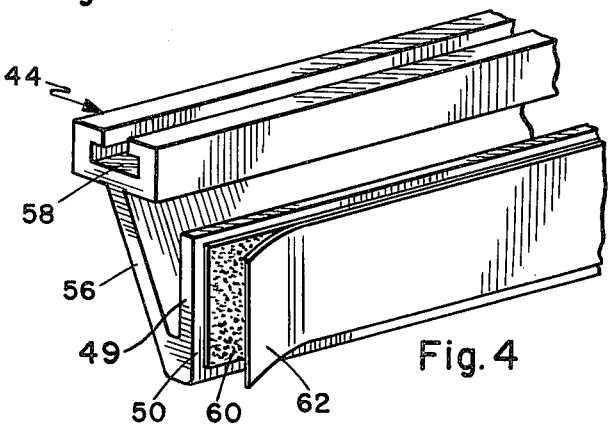
FIG. 4 is a perspective view of a portion of the elongated weatherstripping holder shown in FIG. 2.

Referring to the Drawing the improved weatherstripping kit of the present invention is illustrated as being applied to a sliding window 10 that slides horizontally within a window jamb 20. The sliding window 10 includes a window pane 11 that is set within a window frame 12 by a rubber seal 13. The sliding window 10 is installed within upper and lower opposing window channels respectively defined by upper side channel walls 14 and lower side channels walls 16 for movement parallel to an adjacent stationary window panel 18. Typically, the channel walls 14, 16 extend from the base plate 17 of the window jamb 20. The stationary window panel 18 includes a window pane 19 that is set within the window jamb 20 and a stationary window frame 22 by a rubber seal 24. Rollers 26 are attached to the sliding window frame 12 on the lower side 28 of the sliding window 10 to facilitate movement of the sliding window 10 in the lower channel 30.

The window jamb 20 also has end channel walls 31 for defining an end channel for receiving one end 33 of the sliding window 10 when the sliding window 10 is closed.

A pair of first elongated weatherstripping holders 32 are attached respectively to an upper channel wall 14 and a lower channel wall 16 for holding weatherstripping 35 in contact with the frame 12 of the sliding window 10 for providing a seal between the respective channel wall 14, 16 and the sliding window 10 over the width of the window 10 when the sliding window 10 is closed.

Each first elongated holder 32 includes a flat attachment surface 37 running the length of the first holder 32 for engagement with the outside 38 of the respective upper and lower channel walls 14, 16.

An adhesive strip 40 is provided for attaching the flat attachment surface 37 of each first elongated holder 32 to the channel wall 14, 16. A peel-off protective strip 41 covers the adhesive strip 40 prior to installation of the first elongated holder 32.

Each first elongated holder 32 is shaped to define a T-slot 42 running the length of the first holder for holding weatherstripping 35. The T-slot 42 faces in the same direction as the flat attachment surface 37 and extends beyond the attachment surface 37 in such same direction for holding the weatherstripping 35 in contact with the sliding window 10 when the attachment surface 37 is attached to the outside surface 38 of the channel wall 14, 16.

Each first elongated holder 32 preferably is made of a single piece of extruded aluminum that integrally defines the flat attachment surface 37 and the T-slot 42.

A second elongated weatherstripping holder 44 is attached to the sliding window 10 at the end 46 of the sliding window 10 that is adjacent the stationary window panel 18 for holding weatherstripping 48 in contact with the stationary window panel 18 for providing a seal between the sliding window 10 and the stationary window panel 18 over the length of the sliding window 10.

The second elongated holder 44 includes an attachment wall 49 having an elongated attachment surface 50 on the front side of the attachment wall 49 running the length of the second holder 44 for engagement with the end surface 52 of the adjacent end 46 of the sliding window 10.

The second elongated holder 44 includes an extension wall 56 running the length of the second holder 44 and from the attachment wall 49 inclined rearwardly at an acute angle. The second holder 44 is shaped at the extended end of the extension wall 56 to define a T-slot 58 running the length of the second holder 44 for holding the weatherstripping 48. The T-slot 58 faces in a direction that is ninety degrees from the direction faced by the attachment surface 50 for holding the weatherstripping 48 in contact with the stationary window panel 18 when the attachment surface 50 is attached to the end surface 52 of the sliding window 10.

The second elongated holder 44 preferably is made of a single piece of extruded aluminum that integrally defines the attachment surface 50, the extension wall 56 and the T-slot 58.

An adhesive strip 60 is provided for attaching the attachment surface 48 of the second elongated holder 44 to the end surface 52 of the sliding window 10. A peel-off protective strip 62 covers the adhesive strip 60 prior to installation of the second elongated holder 44.

Figure 5:
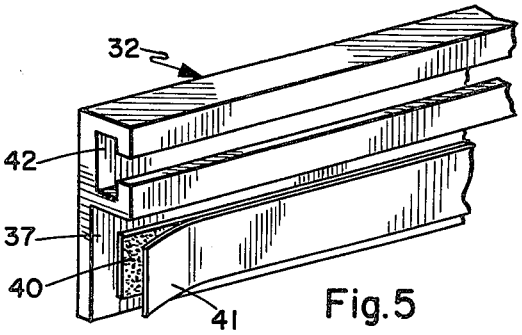
FIG. 5 is a perspective view of a portion of the elongated weatherstripping holder shown in FIG. 3.

A third elongated weatherstripping holder 64, that is constructed in the same manner as the first elongated weatherstripping holder 32 (FIG. 5), is attached to an end channel wall 31 for holding weatherstripping in contact with the received end 33 of the sliding window 10 for providing a seal between the end channel wall 31 and the sliding window 10 over the length of the window 10 when the sliding window 10 is closed.

The weatherstripping kit of the present invention is relatively inexpensive and easy to install. Also, it is made of the same material (aluminum) as the jams and frames as most sliding windows and thereby does not distract from the appearance thereof.

I claim:

1. A weatherstripping kit for sliding windows that are installed within opposing window channels defined by side channel walls, for movement parallel to an adjacent stationary panel, comprising:

a first elongated weatherstripping holder for attachment to a said side channel wall for holding weatherstripping in contact with said sliding window for providing a seal between said channel wall and said window over the width of said window when said window is closed; and a second elongated weatherstripping holder for attachment to said sliding window at the end of the window adjacent the stationary panel for holding weatherstripping in contact with said stationary panel for providing a seal between said window and said panel over the length of said window;

wherein the first elongated holder includes a flat attachment surface running the length of the first holder for engagement with said side channel wall;

wherein the first elongated holder is shaped to define a T-slot running the length of the first holder for holding weatherstripping, facing in the same direction as the flat attachment surface and extending beyond the attachment surface in said same direction for holding said weatherstripping in contact with said sliding window when the attachment surface is attached to the outside of said side channel wall;

wherein the second elongated holder includes an attachment wall having an elongated flat attachment surface on the front holder for engagement with said adjacent end of said sliding window; and wherein the second elongated holder includes an extension wall running the length of the second holder and inclined rearwardly at an acute angle from the attachment wall; and wherein the second elongated holder is shaped at the extended end of the extension wall to define a T-slot running the length of the second holder for holding weatherstripping and facing in a direction that is ninety degrees from the direction faced by the attachment surface for holding said weatherstripping in contact with said stationary panel when the attachment surface is attached to the end surface of said adjacent end of said sliding window.

2. A weatherstripping kit according to claim 1, including two of the first elongated weatherstripping holders for attachment respectively to side channel walls of both of said opposing window channels.

3. A weatherstripping kit according to claims 1 or 2, for sliding windows that are installed within a window jamb having end channel walls defining a channel for receiving one end of the sliding window when the window is closed, the kit further comprising:

a third elongated weatherstripping holder for attachment to said end channel wall for holding weatherstripping in contact with said received end of said sliding window for providing a seal between said end channel wall and said window over the length of said window when said window is closed.

4. A weatherstripping kit according to claim 1, wherein the first elongated holder consists of a piece of extruded aluminum that integrally defines the flat attachment surface and the T-slot.

5. A weatherstripping kit according to claim 1, further comprising an adhesive strip for attaching the flat attachment surface of the first elongated holder to said side channel wall.

6. A weatherstripping kit according to claim 1, wherein the second elongated holder consists of a piece of extruded aluminum that integrally defines the flat attachment surface, the extension wall and the T-slot.

7. A weatherstripping kit according to claim 1, further comprising:

an adhesive strip for attaching the flat attachment surface of the second elongated holder to said adjacent end of said sliding window.

8. A weatherstripping holder for sliding windows that are installed for movement parallel to an adjacent stationary panel, comprising:

an elongated weatherstripping holder for attachment to said sliding window at the end of the window adjacent the stationary panel for holding weatherstripping in contact with said stationary panel for providing a seal between said window and said panel over the length of said window;

wherein the elongated holder includes an attachment wall having an elongated flat attachment surface on the front side of the attachment wall running the length of the holder for engagement with said adjacent end of said sliding window; and wherein the elongated holder includes an extension wall running the length of the holder and inclined rearwardly at an acute angle from the attachment wall; and wherein the elongated holder is shaped at the extended end of the extension wall to define a T-slot running the length of the holder for holding weatherstripping and facing in a direction that is ninety degrees from the direction faced by the attachment surface for holding said weatherstripping in contact with said stationary panel when the attachment surface is attached to the end surface of said adjacent end of said sliding window.

9. A weatherstripping holder according to claim 8, wherein the elonated holder consists of a piece of extruded aluminum that integrally defines the flat attachment surface, the extension wall and the T-slot.

10. A weatherstripping holder according to claim 8, further comprising:

an adhesive strip for attaching the flat attachment surface of the elongated holder to said adajcent end of said sliding window.

11. A system, comprising a sliding window structure including a window and opposing window channels defined by side channel walls for supporting the window for sliding movement parallel to an adjacent stationary panel;

a first elongated weatherstripping holder attached to said side channel wall for holding weatherstripping in contact with the window for providing a seal between said channel wall and the window over the width of the window when the window is closed; and a second elongated weatherstripping holder attached to the window at the end of the window adjacent said stationary panel for holding weatherstripping in contact with said stationary panel for providing a seal between the window and said panel over the length of the window;

wherein the first elongated holder includes a flat attachment surface running the length of the first holder and attached to the outside of said side channel wall;

wherein the first elongated holder is shaped to define a T-slot running the length of the first holder for holding weatherstripping, facing in the same direction as the flat attachment surface and extending beyond the attachment surface in said same direction for holding said weatherstripping in contact with the window;

wherein the second elongated holder includes an attachment wall having an elongated flat attachment surface on the front side of the attachment wall running the length of the second holder and attached to said adjacent end of the window; and wherein the second elongated holder includes an extension wall running the length of the second holder and inclined rearwardly at an acute angle from the attachment wall; and wherein the second elongated holder is shaped at the extended end of the extension wall to define a T-slot running the length of the second holder for holding weatherstripping and facing in a direction that is ninety degrees from the direction faced by the attachment surface for holding said weatherstripping in contact with said stationary panel.

12. A system according to claim 11, including two of the first elongated weatherstripping holders attached respectively to the side channel walls of both of the opposing window channels.

13. A system according to claim 11, wherein the sliding window structure further includes end channel walls defining a channel for receiving one end of the window when the window is closed, the system further comprising a third elongated weatherstripping holder attached to the end channel wall for holding weatherstripping in contact with said received end of the sliding window for providing a seal between the end channel wall and the window over the length of the window when the window is closed.

14. A system comprising a sliding window structure including a window and means for supporting the window for movement parallel to an adjacent stationary panel;

an elongated weatherstripping holder attached to the window at the end of the window adjacent said stationary panel for holding weatherstripping in contact with said stationary panel for providing a seal between the window and said panel over the length of the window;

wherein the elongated holder includes an attachment wall having an elongated flat attachment surface on the front side of the attachment wall running the length of the holder and attached to adjacent end of the window; and wherein the elongated holder includes an extension wall running the length of the holder and inclined rearwardly at an acute angle from the attachment wall; and wherein the elongated holder is shaped at the extended end of the extension wall to define a T-slot running the length of the holder for holding weatherstripping and facing in a direction that is ninety degrees from the direction faced by the attachment surface for holding said weatherstripping in contact with said stationary panel.

* * * * *